US006887130B2

(12) United States Patent
Lee et al.

(10) Patent No.: US 6,887,130 B2
(45) Date of Patent: May 3, 2005

(54) CHEMICAL MECHANICAL POLISHING APPARATUS

(75) Inventors: Jong-Won Lee, Seongnam-si (KR); Chang-Ki Hong, Seongnam-si (KR); Ho-Young Kim, Seongnam-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/795,370

(22) Filed: Mar. 8, 2004

(65) Prior Publication Data

US 2004/0203323 A1 Oct. 14, 2004

(30) Foreign Application Priority Data

Apr. 10, 2003 (KR) ..... 10-2003-0022764

(51) Int. Cl.[7] ..... B24B 49/00
(52) U.S. Cl. ..... 451/14; 451/285
(58) Field of Search ..... 451/11, 14, 285, 451/286, 287, 288, 289, 41

(56) References Cited

U.S. PATENT DOCUMENTS 5,934,979 A * 8/1999 Talieh ..... 451/41

* cited by examiner

*Primary Examiner*—Dung Van Nguyen
(74) *Attorney, Agent, or Firm*—F. Chau & Associates LLC; Frank V. DeRosa

(57) ABSTRACT

A chemical mechanical polishing (CMP) apparatus includes a plate that holds a substrate, a pad assembly unit comprising a pad support device, a positioning device, and a rotation device operatively connected to the pad assembly unit. The pad support device comprises a plurality of support plates to which pad pieces of a polishing pad can be attached. The positioning device can move at least one of the plurality of support plates in a direction along a surface of the semiconductor substrate to be polished. Further, the CMP apparatus can control the polishing amount along any portion of a surface of a wafer to be polished.

24 Claims, 15 Drawing Sheets

CHEMICAL MECHANICAL POLISHING APPARATUS

TECHNICAL FILED OF THE INVENTION

The present invention relates, generally, to an apparatus for fabricating a semiconductor device and, more particularly, to a chemical mechanical polishing apparatus for polishing a surface of a semiconductor wafer.

BACKGROUND

A semiconductor device fabricating process includes a deposition process for forming a thin film on a wafer and an etch process for forming a fine circuit pattern on the thin film. These processes are repeatedly carried out until a desired circuit pattern is formed on the wafer. Following formation of the circuit pattern, a large number of windings are formed at the surface of the wafer. With the recent trend toward finer semiconductor devices, the structure of semiconductor devices is multi-layered and the number of windings formed at the wafer surface and a step difference therebetween are increasing. If the wafer surface is not planarized, problems such as defocus occur during a photolithographic process. Thus, the wafer surface must periodically be polished so as to be planarized.

A variety of surface planarizing techniques have been developed to planarize a wafer surface. Particularly, a chemical mechanical polishing (CMP) apparatus is widely used due to the superior planarity that can be obtained for a narrow area as well as a wide area.

The CMP apparatus chemically mechanically polishes a wafer surface coated with tungsten or oxide and can achieve a very fine polishing. Mechanical polishing is performed by rotating a wafer that is pressed against a polishing pad, so there is a frictional force between the polishing pad and the wafer surface to polish the wafer surface. Chemical polishing is performed by polishing a wafer surface by feeding slurry, which is a chemical abrasive agent, between a polishing pad and a wafer.

Referring to FIG. 1, a conventional chemical mechanical polishing (CMP) apparatus has a platen 120 to which a polishing pad 140 is attached, and a polishing head 160 is disposed over the platen 120. A wafer is mounted on the polishing head 160 such that a polishing surface is disposed against a polishing pad. The polishing head 160 applies a controllable pressure to a rear surface of a wafer to polish the wafer.

According to the above-described CMP apparatus, an entire surface of the wafer can regularly be polished while the amount of polishing a partial surface of the wafer cannot be controlled. Therefore, in a case where a wafer surface is winded because the deposition thickness on each part of the wafer is different, the windings are left even after the polishing process. That is, the wafer is not uniformly planarized.

Generally, a diameter of the polishing pad 140 is at least two times larger than that of a wafer, and the wafer rotates on the axis of the polishing pad 140. Thus, as the wafer diameter increases from 200 mm to 300 mm, the diameter of the polishing pad 140 becomes larger, thereby increasing manufacturing costs because a larger size polishing pad is required.

Therefore, a need exists for a chemical mechanical polishing apparatus that uniformly planarizes a semiconductor wafer having a deposition of varying thickness on each portion of a wafer and that accommodates larger size semiconductors wafers without increasing the size of the polishing pad required to planarized a surface of a semiconductor wafer.

SUMMARY OF THE INVENTION

Exemplary embodiments of the invention generally include a chemical mechanical polishing (CMP) apparatus which can readily regulate the amount of polishing for each part of a wafer and which does not require the diameter of a polishing pad to be increased as a diameter of a semiconductor wafer increases.

According to an exemplary embodiment of the present invention, a chemical mechanical polishing (CMP) apparatus comprises a plate that holds a substrate, a pad assembly unit comprising a pad support device and a positioning device, wherein the pad support device comprises a plurality of support plates to which pad pieces of a polishing pad can be attached, and wherein the positioning device can move at least one of the plurality of support plates in a direction along a surface of the substrate to be polished, and a rotation device operatively connected to the pad assembly unit.

According to another exemplary embodiment of the present invention, the CMP apparatus includes a polishing pad including pad pieces. The polishing pad has a circular shape, a triangular shape, a quadrangular shape, or an elliptical shape. The positioning device moves at least one of the plurality of support plates to a position between a center region and an edge region of a substrate. The positioning device includes a motor, a screw that rotates by operation of the motor, and a rod which is connected to one of the plurality of support plates and which moves by rotation of the screw. In another embodiment, a CMP apparatus further comprises a controller to control a rotation speed of the motor.

According to still another exemplary embodiment of the present invention, the plurality of support plates includes a fixed support plate and a plurality of movable support plates disposed around the fixed support plate. The positioning device includes a motor, a screw that rotates by operation of the motor, and a rod which is connected to one of the movable support plates and which moves by rotation of the screw. According to another embodiment, the CMP apparatus comprises a controller to control a rotation speed of the motor.

According to another embodiment, a CMP apparatus comprises a polishing pad including pad pieces. Preferably, the polishing pad including the pad pieces has a circular shape, a triangular shape, or an elliptical shape.

According to yet another exemplary embodiment of the present invention, a chemical mechanical polishing (CMP) apparatus comprises a plate that holds a substrate, a pad assembly unit comprising a pad support device and a positioning device. The pad support device comprises a plurality of support plates to which pad pieces of a polishing pad can be attached. The positioning device comprises a housing, a plurality of motors attached to the housing, a plurality of screws rotatably attached to the housing, wherein each screw is coupled to a corresponding motor, and a plurality of connecting rods each having a screw groove, wherein each connecting rod is coupled to a corresponding support plate and to a corresponding screw through the screw groove. The CMP apparatus further comprises a rotation device operatively connected to the pad assembly unit.

According to another embodiment, each motor of the positioning device rotates a corresponding screw to move a corresponding support plate back and forth along an axial direction of the screw.

According to another embodiment, the rotational device operatively coupled to the housing rotates the housing and the plurality of support plates about the substrate to be polished.

According to another embodiment, the CMP apparatus further comprises a controller to control a rotation speed of the motors.

According to another embodiment, the plurality of support plates together forms a circular shape, a quadrangular shape, a triangular shape, or an elliptical shape.

According to another embodiment, the plurality of support plates includes a fixed support plate and a plurality of movable support plates disposed around the fixed support plate. Preferably, the fixed support plate is a circular shape, a triangular shape, or an elliptical shape, and the movable support plates disposed around the fixed support plate form a circular shape, a triangular shape, or an elliptical shape.

According to another embodiment, the CMP apparatus further comprises a polishing pad comprising a plurality of pad pieces attached to the plurality of support plates. Preferably, the polishing pad has a circular shape, a triangular shape, a quadrangular shape, or an elliptical shape.

According to still yet another exemplary embodiment of the present invention, a pad assembly unit for a chemical mechanical polishing (CMP) apparatus comprises a pad support device comprising a plurality of support plates to which pad pieces of a polishing pad can be attached, and a positioning device that can move at least one of the plurality of support plates in a direction along a surface of a substrate to be polished.

These and other exemplary embodiments, features, aspects, and advantages of the present invention will be described and become apparent from the following detailed description of the exemplary embodiments when read in conjunction with the accompanying drawings.

DETAILED DESCRIPTION OF EXEMPLARY EMBODIMENTS

Figure 1:
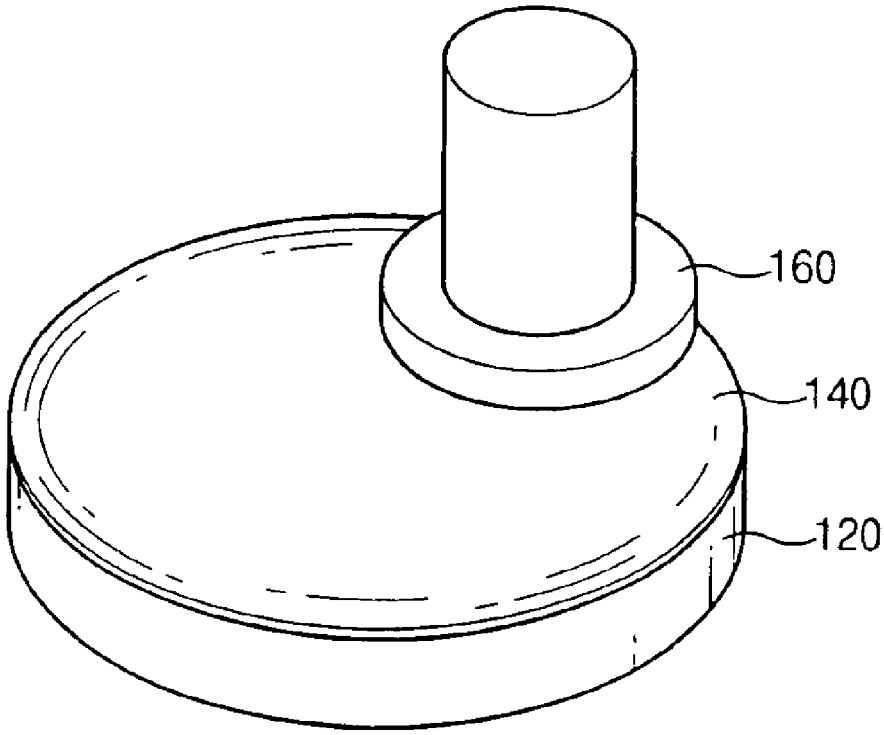
Fig. 1 (PRIOR ART)
FIG. 1 is a perspective view of a typical chemical mechanical polishing (CMP) apparatus.
Figure 2:
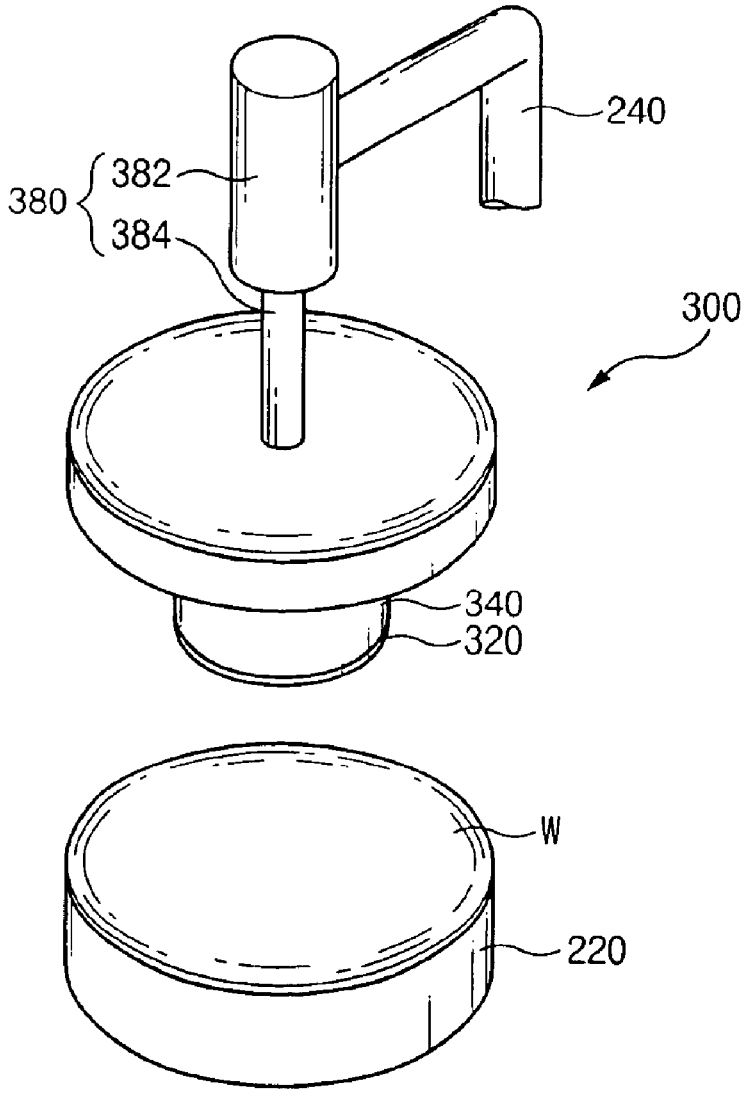
FIG. 2 is a perspective view of a CMP apparatus according to an exemplary embodiment of the present invention.

A chemical mechanical polishing (hereinafter referred to as "CMP") apparatus according to an exemplary embodiment of the present invention will now be described with reference to FIG. 2. The CMP apparatus includes a rotation plate 220, a pad assembly (or pad assembly unit) 300 and a vertical move part 240.

The plate 220 is a circular plate where a wafer W is fixed during a CMP process. A rotation axis (not shown) for supporting the plate 220 and a rotation motor (not shown) for rotating a plate and a rotation axis at a regular speed may be installed below the plate 220. A wafer may be fixed on the plate 220 by means of a chemical clamp or by vacuum absorption.

The pad assembly 300 for polishing a top surface of the wafer W is installed over the plate 220. The pad assembly 300 can be moved up and down by the vertical move part 240. A slurry-feeding arm (not shown) for feeding slurry onto the surface of the wafer W may be disposed at an upper lateral side of the plate 220.

Figure 3A:
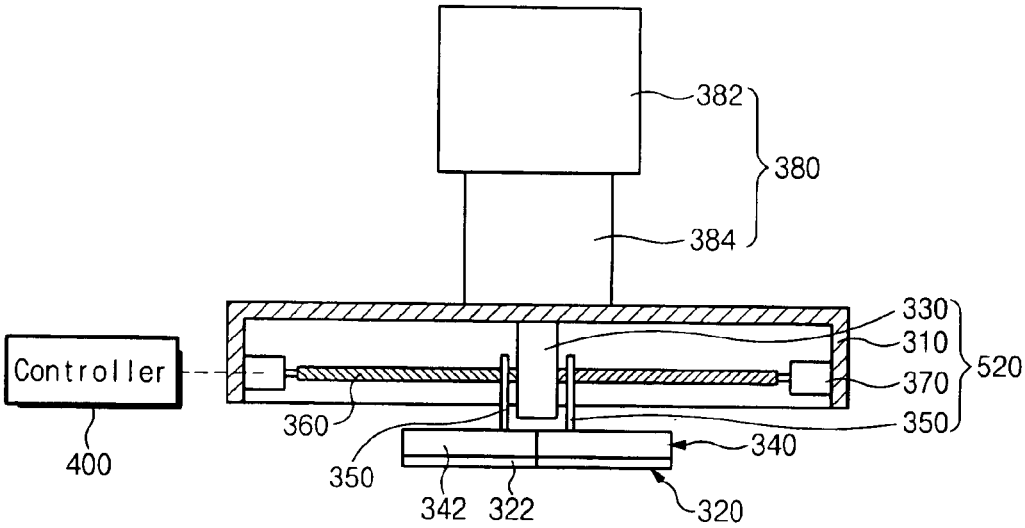
FIG. 3A and FIG. 3B is a cross-sectional view and a bottom view of a pad assembly shown in FIG. 2.
Figure 3B:
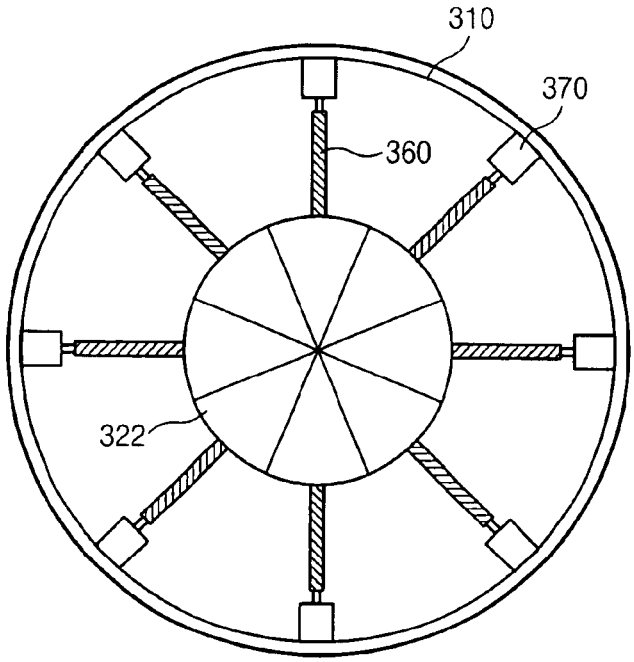

FIG. 3A is a cross-sectional view of the pad assembly 300 according to an exemplary embodiment of the present invention, and FIG. 3B is a bottom view thereof. Referring to FIG. 3A and FIG. 3B, the pad assembly 300 has a polishing pad 320, a support part (or pad support device) 340, a horizontal move part (or positioning device) 520, a rotation part (or rotational device) 380, and a controller 400.

Figure 4A:
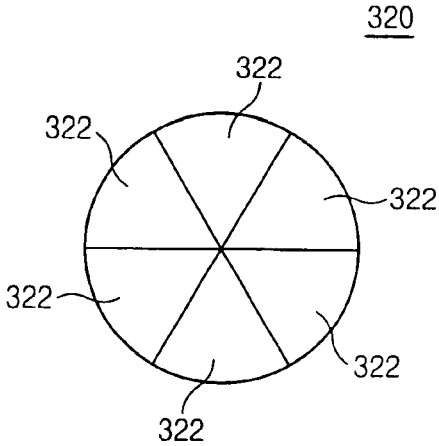
FIG. 4A through FIG. 4D illustrate various phenomena of a polishing pad shown in FIG. 3B.
Figure 4B:
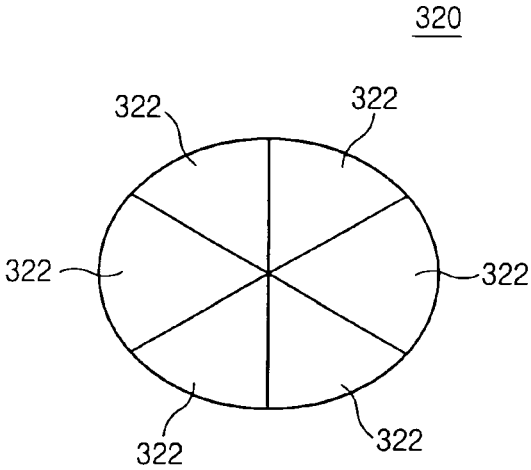
Figure 4C:
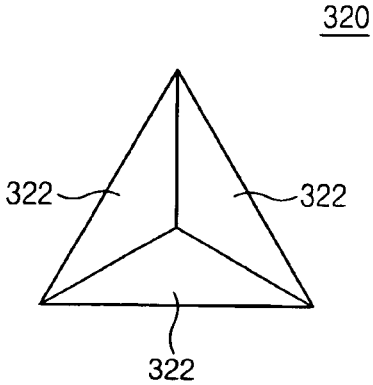
Figure 4D:
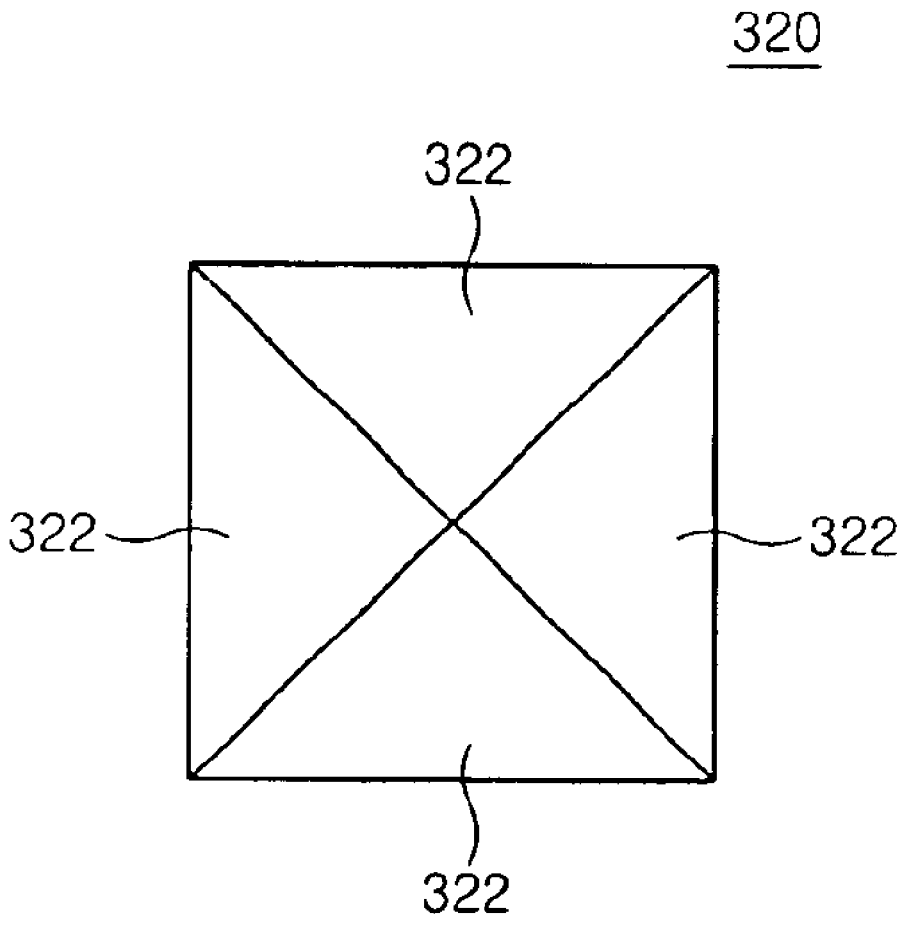

The polishing pad 320 is a flat pad having a predetermined thickness and is in direct contact with a wafer W to mechanically polish the wafer W. The polishing pad 320 is supported by the support part 340 and rotates with the support part 340 during a process. In this invention, the polishing pad 320 may have various shapes. For example, the polishing pad 320 may have a circular pad shape, as shown in FIG. 4A. Alternatively, the polishing pad 320 may have an elliptic pad shape, as shown in FIG. 4B. Alternatively, the polishing pad 320 may have a polygonal pad shape (e.g., triangle or quadrangle), as shown in FIGS. 4C and 4D. The polishing pad 320 has a smaller cross-sectional area than a wafer. For example, in a case where the polishing pad 320 has a circular shape, the polishing pad 320 may have a ½ to ⅓ smaller diameter than the wafer W.

Figure 5A:
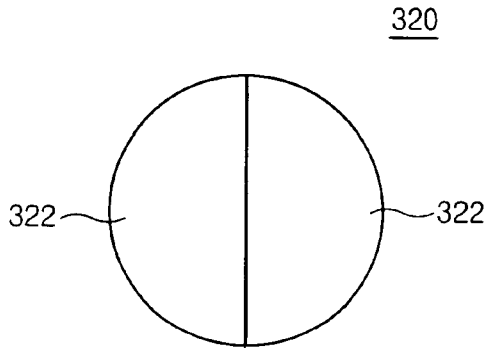
FIG. 5A through FIG. 5C illustrate polishing pads having a various number of pad pieces.
Figure 5B:
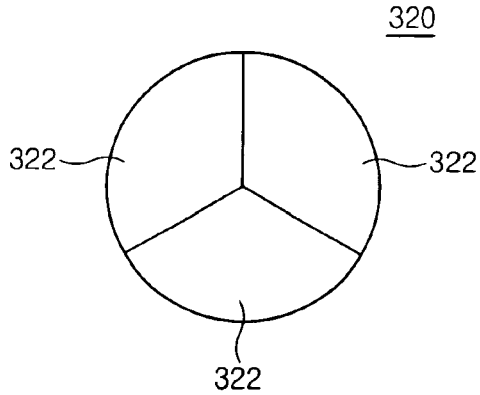
Figure 5C:
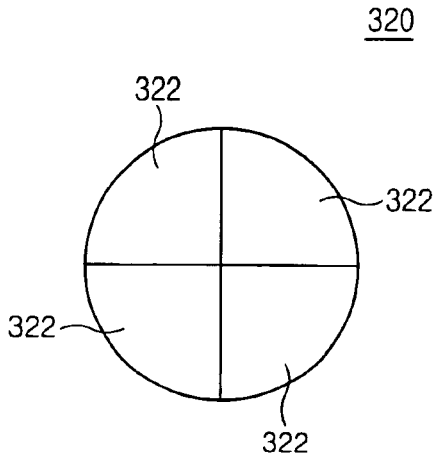

In this embodiment, the polishing pad 320 comprises a plurality of pad pieces 322. In a case where the polishing pad has a circular pad shape, each of the pad pieces 322 may have the shape of a fan whose central angle is 45°. Unlike this, as shown in FIG. 5A, FIG. 5B, and FIG. 5C, the polishing pad 320 may comprise two, three or four pad pieces 322. In addition, the polishing pad may comprise more than four pad pieces.

The polishing pad 320 is attached to the support part 340, wherein the support part 340 has the same shape as the polishing pad 320. The support part 340 has a plurality of support plates to which the respective pad pieces 322 are attached. Each of the support plates 342 may have the same shape and size as the pad piece 322.

A horizontal move part 520, or positioning device, is disposed on the support part 340 to move the respective pieces 322 of the polishing pad 320 from the center of a wafer W to the edge thereof or from the edge of the wafer W to the center thereof. The horizontal move part 520 has a housing 310, a fixed projection 330, screws 360, connecting rods 350, and motors 370. The housing 310 has the shape of a cylinder whose bottom is open, and constitutes an outward form of the horizontal move part 520. The fixed projection 330 is disposed at the center of an upper portion inside the housing 310. One end of the respective screws 360, which are uniformly disposed, is inserted into the fixed projection 330. The number of the screws 360 is equal to that of the pad pieces 322. The motor 370 is connected to the other end of the respective screws 360. The screws 360 have a length that allows the pad pieces 322 to be moved from a center portion of a wafer to an edge portion of a wafer. One end of the respective connecting rods 350 is fixed to an upper portion of the support plate 342 disposed at a corresponding position. A screw groove, into which the screw 360 is inserted, is formed at the other end of the respective connecting rods 350. That is, when the motor 370 rotates in one direction, the screw 360 connected thereto rotates to straightly move the support plate 342, to which the pad pieces 322 are attached, from the center of the wafer to the edge thereof or from the edge of the wafer to the center thereof.

A rotation part 380, or rotational device, for rotating the horizontal move part 520 and the polishing pad 320 is connected to a top portion of the horizontal move part 520. The rotation part 380 has a driving axis 384 and a motor 382. The driving axis 384 is fixed to a center of the top portion of the horizontal move part 520, and the motor 382 for rotating the driving axis 384 is connected to a top portion of the driving axis. By the rotation part 380, the polishing pad 320 rotates on the driving axis 384 in the same direction as a wafer W or in the reverse direction to the wafer W.

Figure 6A:
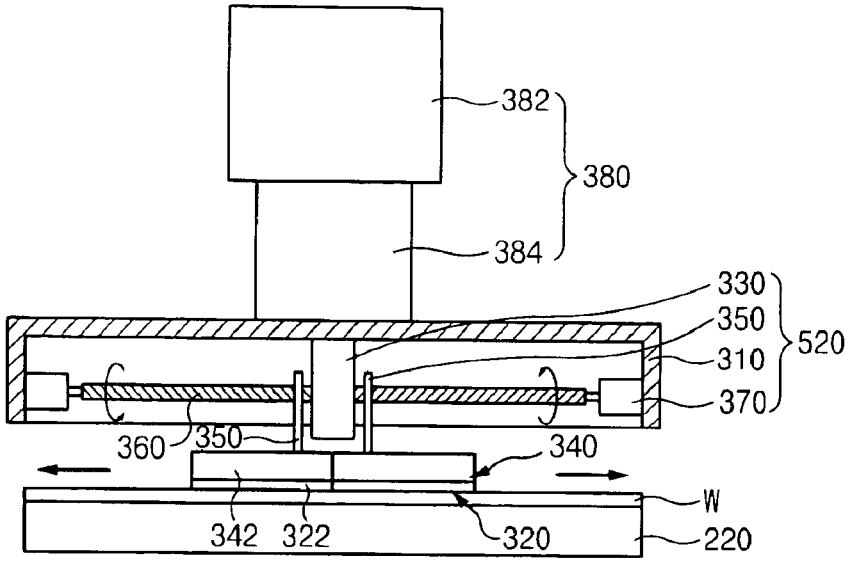
FIG. 6A and FIG. 6B are a cross-sectional view and a bottom view showing that the respective pads pieces concentrate at the center of a wafer in accordance with the exemplary embodiment of FIGS. 3A and 3B.
Figure 6B:
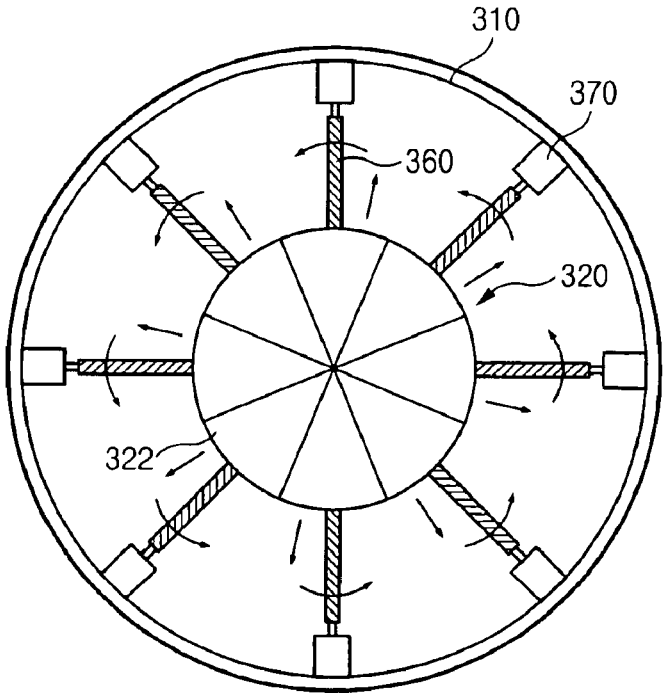
Figure 7A:
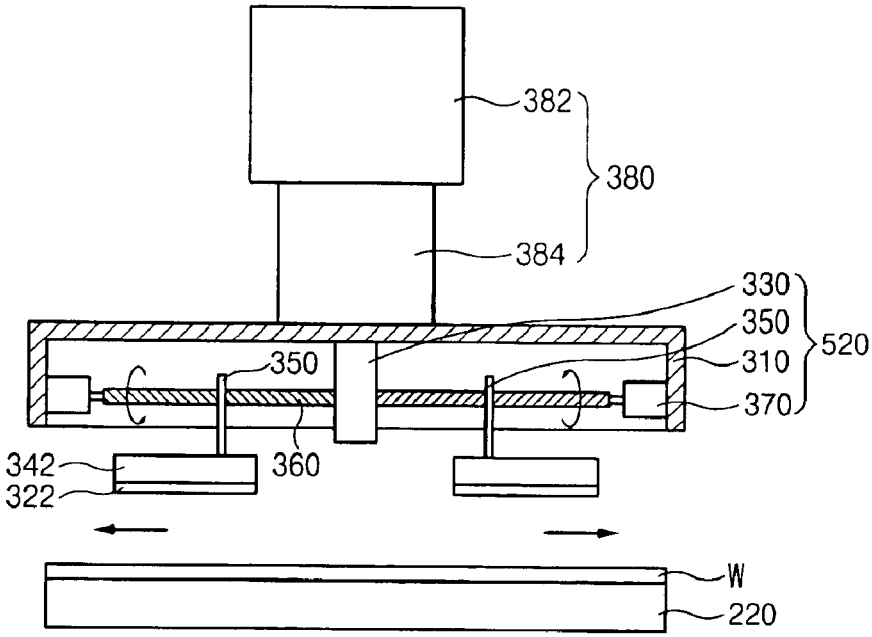
FIG. 7A and FIG. 7B are a cross-sectional view and a bottom view showing the pad pieces move a predetermined distance along a radius direction of a wafer in accordance with the exemplary embodiment of FIGS. 3A and 3B.
Figure 7B:
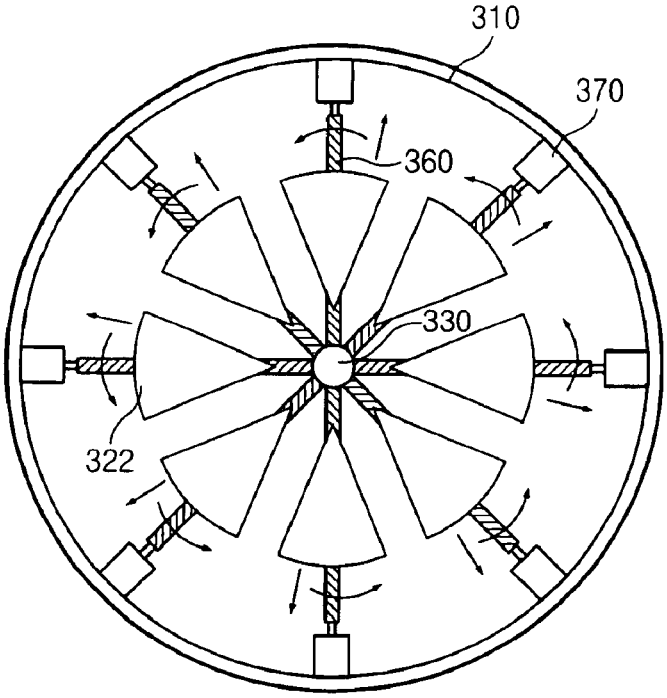
Figure 8A:
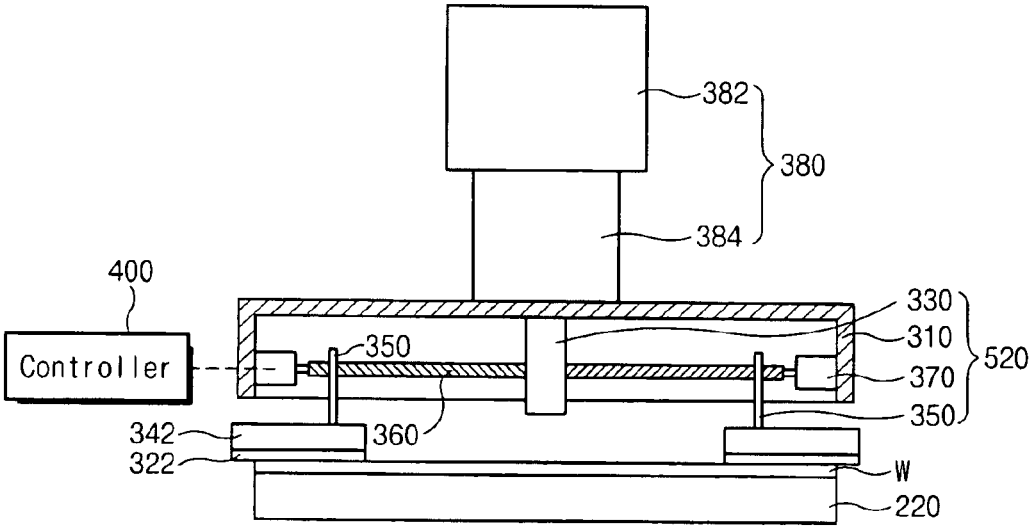
FIG. 8A and FIG. 8B are a cross-sectional view and a bottom view showing that the pad pieces have moved to the edge of a wafer edge in accordance with the exemplary embodiment of FIGS. 3A and 3B.
Figure 8B:
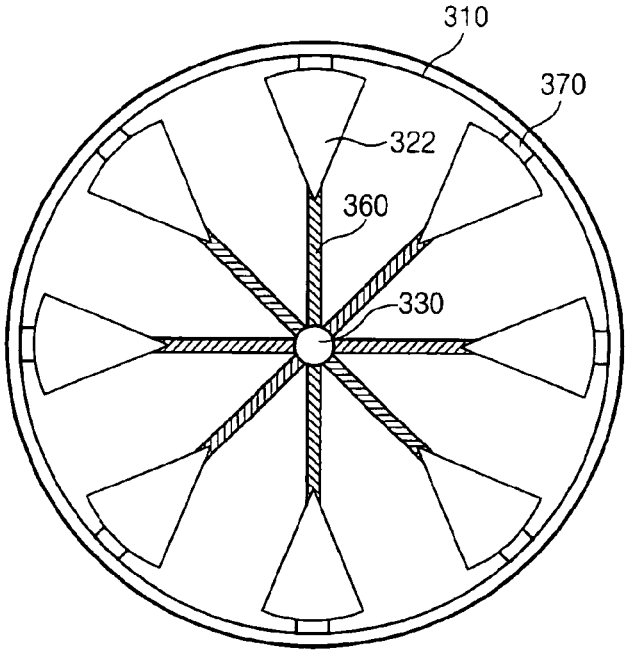

FIG. 6A and FIG. 6B show that the respective pad pieces 322 concentrate at the center of a wafer W during a polishing process in accordance with the exemplary embodiment of FIGS. 3A and 3B, respectively. FIG. 7A and FIG. 7B show that the pad pieces 322 are dispersed in the middle of the wafer W. FIG. 8A and FIG. 8B show that the pad pieces 322 are dispersed at the edge of the wafer W.

As shown in FIG. 6A and FIG. 6B, when a polishing process starts, the pad pieces 322 concentrate at the center of the wafer W to make the polishing pad 320 have a circular shape. When the polishing process is carried out, a horizontal move part 520 rotates together with the polishing pad 320 by a rotation part 380. As a motor 370 rotates in one direction, the respective pad pieces move to the middle of the wafer W to be dispersed, as shown in FIG. 7A and FIG. 7B. If the motor 370 continuously rotates in one direction, the pad pieces moves to the edge of the wafer W, as shown in FIG. 8A and FIG. 8B. If the motor 370 rotates in the other direction, the pad pieces 322 move from the edge of the wafer W to the center thereof through the middle thereof. During the polishing process, the plate 220 to which the wafer W is fixed may be shaken even by a short stroke.

During the polishing process, the wafer W may be polished while the respective pad pieces 322 successively move from the center of the wafer W to the edge thereof or sojourns at a specific position on the wafer W for a predetermined time. For this, a controller 400 for controlling a rotation speed of the motor 370 is provided. For example, when a deposition has a greater thickness at the edge of the wafer than at the center of the wafer, the time the pad pieces 322 sojourn at the edge of the wafer W may be longer than the time the pad pieces 322 sojourn at the center of the wafer W or in the middle thereof.

Figure 9A:
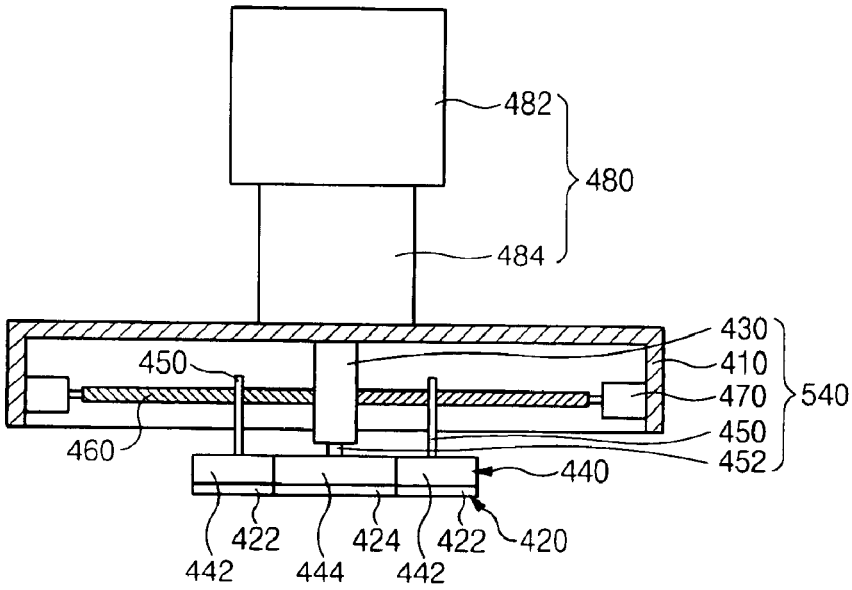
FIG. 9A and FIG. 9B are a cross-sectional view and a bottom view of a pad assembly according to another exemplary embodiment of the present invention.
Figure 9B:
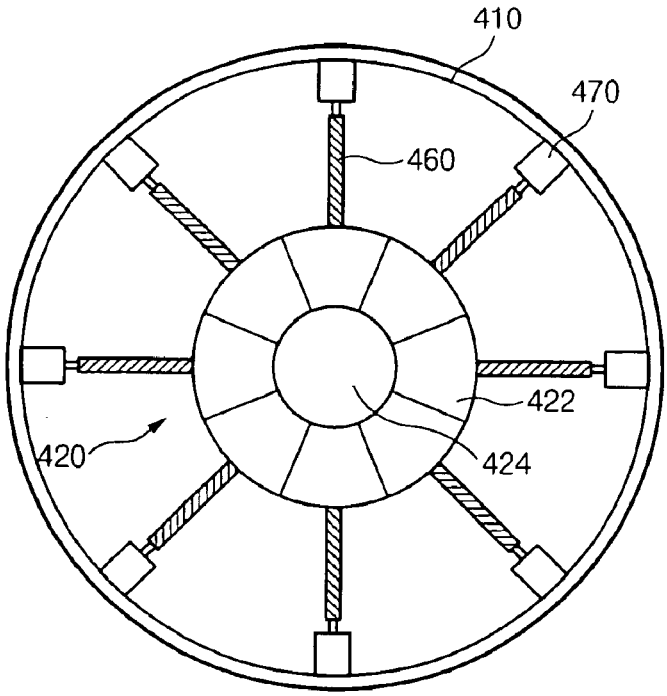

FIG. 9A is a cross-sectional view of a pad assembly 300 according to another exemplary embodiment of the present invention, and FIG. 9B is a bottom view of the pad assembly 300 shown in FIG. 9A. Referring to FIG. 9A and FIG. 9B, the pad assembly 300 has a polishing pad 420, a support part 440, a horizontal move part 540, and a rotation part 480.

Similar to the exemplary embodiment of FIGS. 3A and 3B, the polishing pad 420 comprises a plurality of pad pieces 422 and 424. But the pad piece 424 is a fixed pad piece disposed at the center of a wafer, and the pad pieces 422 are move pad pieces disposed at the edge thereof.

Figure 10A:
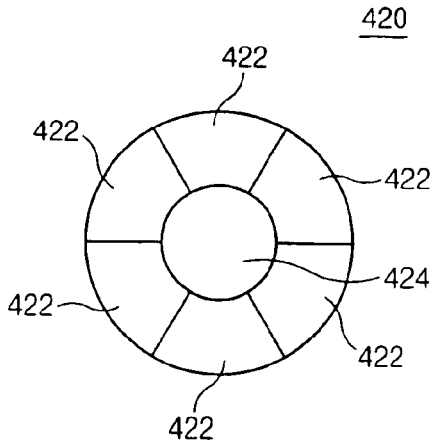
FIG. 10A through FIG. 10C illustrate various shapes of a polishing pad shown in FIG. 9B.
Figure 10B:
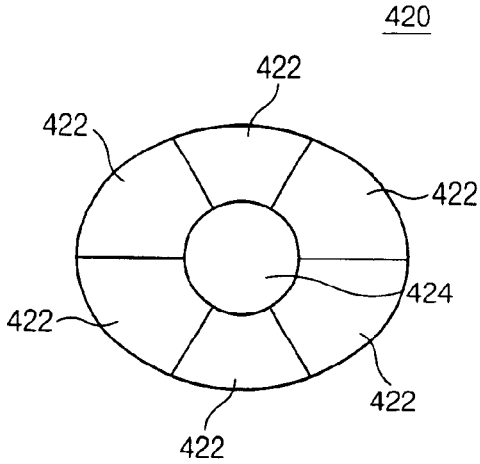
Figure 10C:
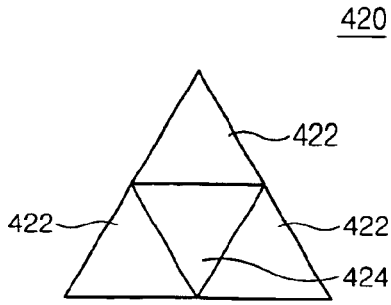
Figure 11A:
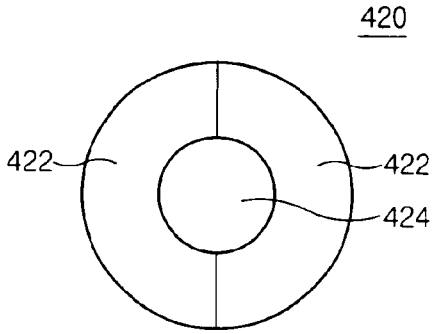
FIG. 11A through FIG. 11C illustrate polishing pads having the various number of pad pieces.
Figure 11B:
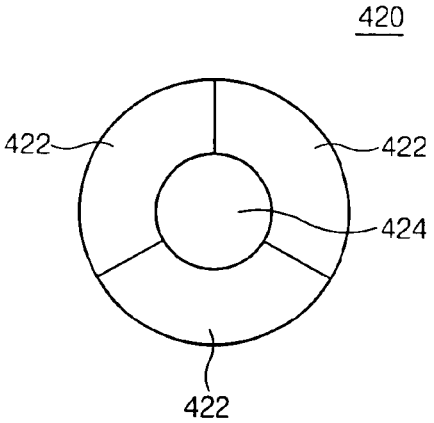
Figure 11C:
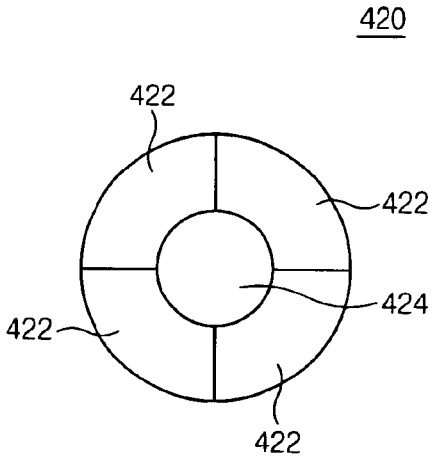

The polishing pad 420 may have various shapes. For example, the polishing pad 420 may have a circular pad shape, as shown in FIG. 10A. Alternatively, the polishing pad 420 may have an elliptical pad shape, as shown in FIG. 10B. Alternatively, the polishing pad 420 may have a triangle pad shape, as shown in FIG. 10C, or a polygonal pad shape (e.g., quadrangular pad shape). In a case where the polishing pad has a circular pad shape, the fixed pad piece 424 has a circular shape and the move pad pieces 422 may be divided into eight parts so as to have a uniform shape. In addition, as shown in FIG. 11A, FIG. 11B, and FIG. 11C, the move pad pieces 422 may be divided into two, three or four parts. Further, the pad pieces 422 may be divided into more than four pieces.

The construction and shape of the horizontal move part 540, or positioning device, according to the exemplary embodiment of FIGS. 9A and 9B are similar to those of the horizontal move part 520 according to the exemplary embodiment of FIGS. 3A and 3B. However, the support part 440 has a fixed support plate 444 to which the fixed pad piece 424 is attached, and a plurality of move support plate 442 to which the move pad pieces 422 are attached. The shape and size of the fixed support plate 444 and the move support plates 442 may be identical to those of the fixed pad piece 424 or the move pad pieces 422. The fixed support plate 444 is directly connected to a fixed projection 430 by a supporting rod 452 to be disposed at the center of a wafer W during a polishing process and does not move toward the edge of the wafer W. Each of the move support plates 442 is coupled to a connecting rod 450 into which a screw 460 is inserted, and is straightly moved by the rotation of the motor 470 during the polishing process.

Figure 12A:
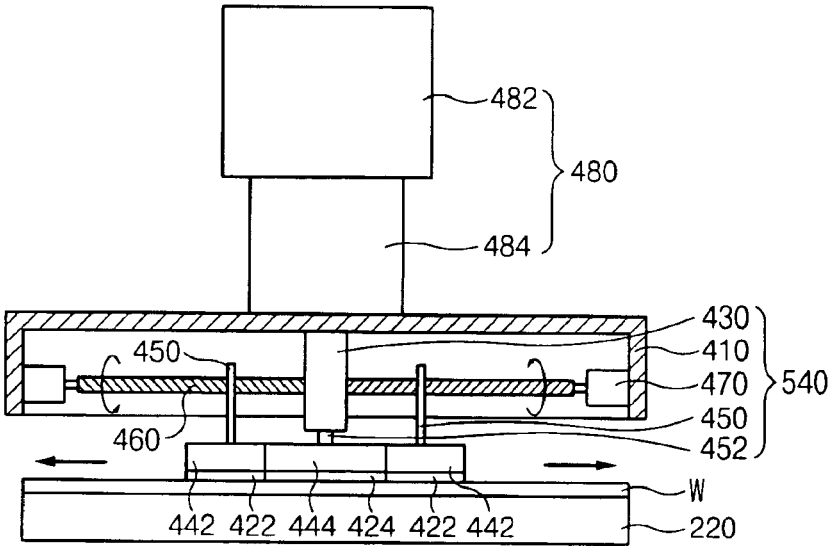
FIG. 12A and FIG. 12B are a cross-sectional view and a bottom view showing that the respective pad pieces concentrate at the center of a wafer in accordance with the exemplary embodiment of FIGS. 9A and 9B.
Figure 12B:
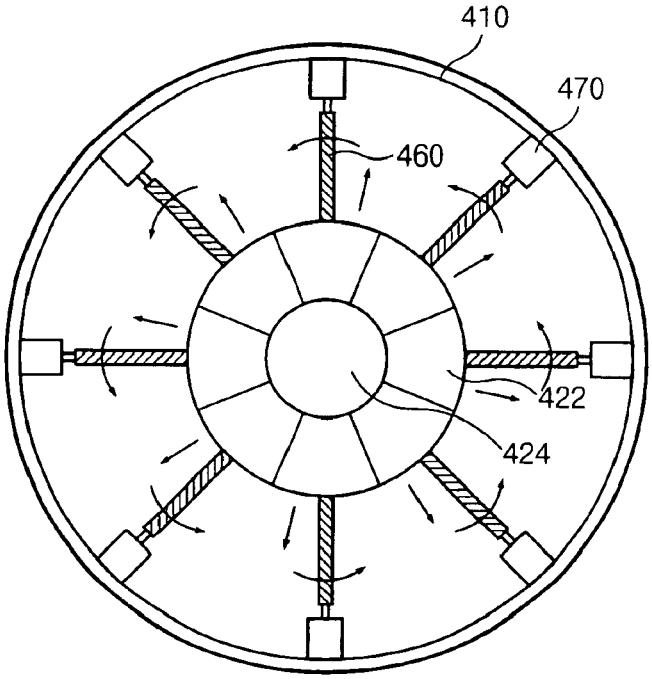
Figure 13A:
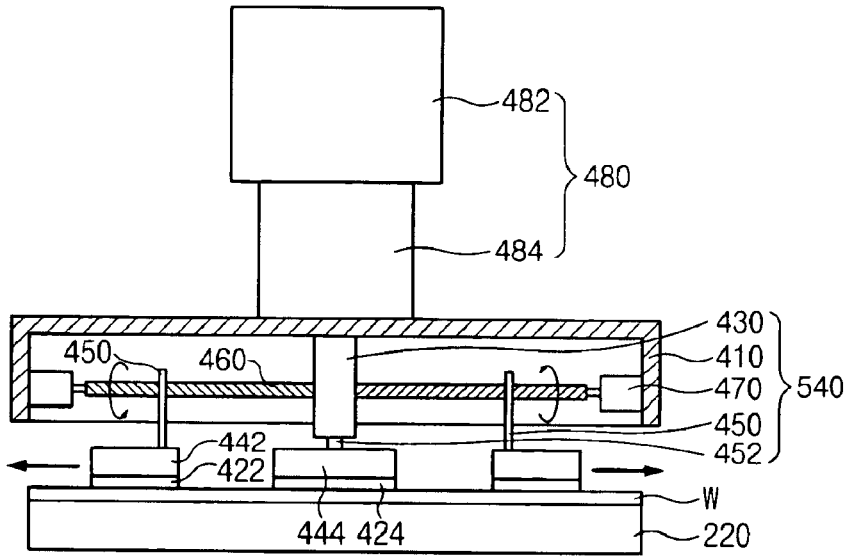
FIG. 13A and FIG. 13B are a cross-sectional view and a bottom view showing that the pad pieces move a predetermined distance along a radius direction of a wafer in accordance with the exemplary embodiment of FIGS. 9A and 9B.
Figure 13B:
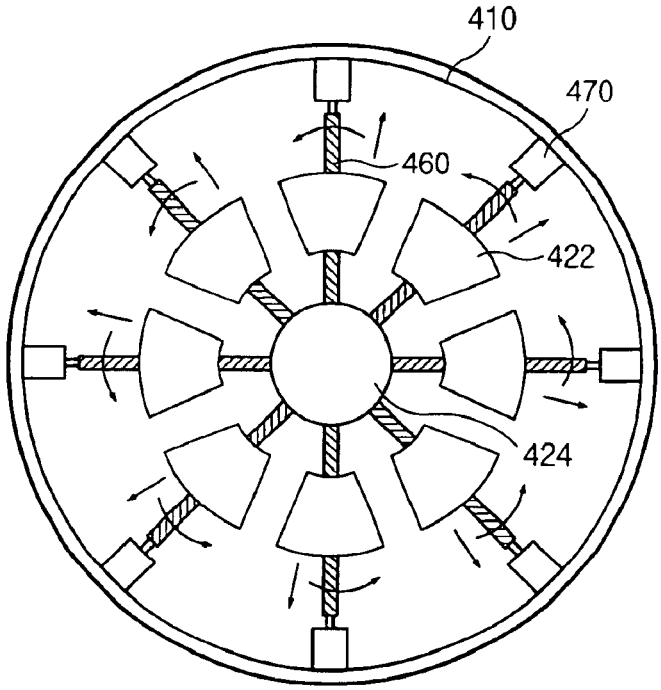
Figure 14A:
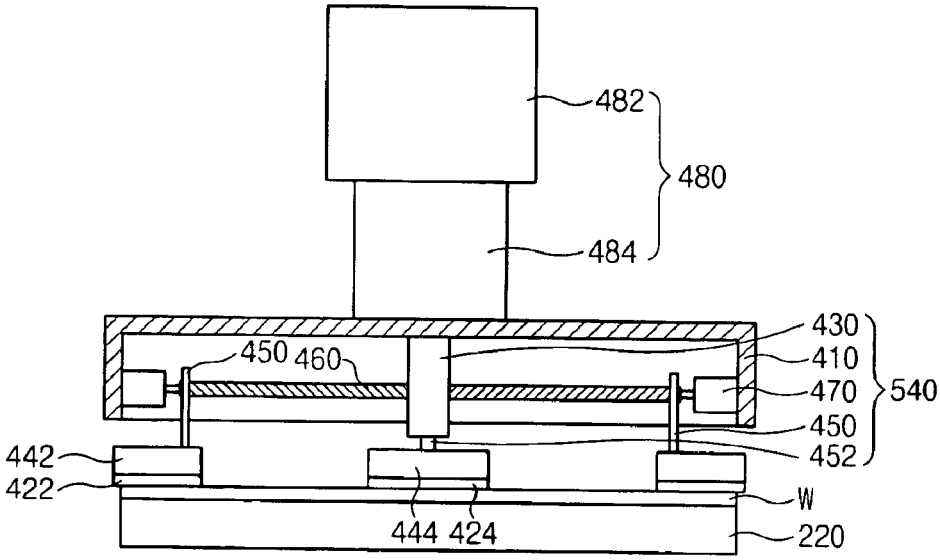
FIG. 14A and FIG. 14B are a cross-sectional view and a bottom view showing that the pad pieces move to the edge of a wafer edge in accordance with the exemplary embodiment of FIGS. 9A and 9B.
Figure 14B:
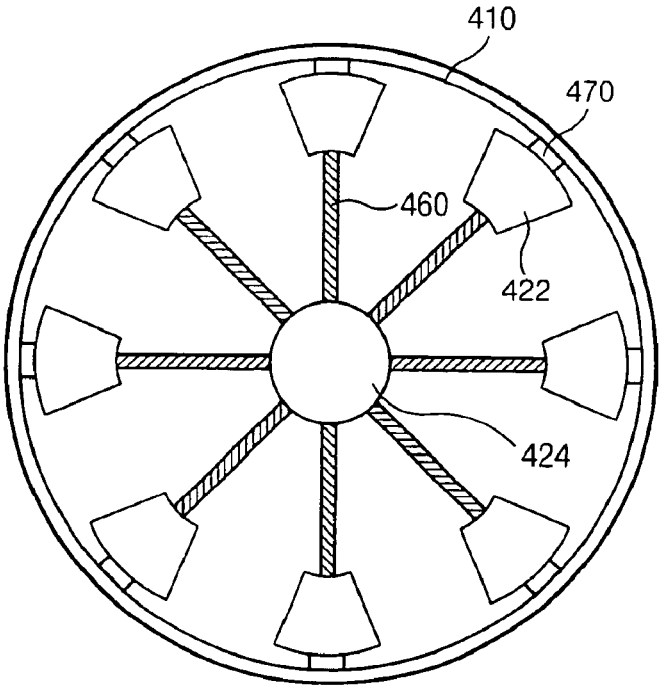

FIG. 12A and FIG. 12B show that the respective pad pieces 422 and 424 concentrate at the center of a wafer W in accordance with the exemplary embodiment of FIGS. 9A and 9B. FIG. 13A and FIG. 13B show that the move pad pieces 422 are dispersed in the middle of the wafer W. FIG. 14A and FIG. 14B show that the move pad pieces 422 are dispersed at the edge of the wafer W.

As shown in FIG. 12A and FIG. 12B, when a polishing process starts, the pad pieces 422 and 424 concentrate at the center of the wafer W to make the polishing pad 420 have a circular shape. When a polishing process is carried out, the horizontal move part 540 rotates, together with polishing pad 420, on a driving axis 484 by a motor 482. As the motor 470 rotates in one direction, the pad piece 424 stays at the center of the wafer W and the respective move pad pieces 422 move toward the middle of the wafer W. If the motor 470 continuously rotates in one direction, the move pad pieces 422 continuously move toward the edge of the wafer W, as shown in FIG. 14A and FIG. 14B.

In the exemplary embodiment of FIGS. 3A and 3B, since fan-shaped pad pieces 322 are used, the insides of the pad pieces 322 are pointed. Thus, a wafer W may be unpolished at portions contacting the pointed insides. But in the exemplary embodiment of FIGS. 9A and 9B, in a case where a circular or elliptical polishing pad 420 is used, the inside of a move pad piece 422 has a constant width. Thus, a wafer W is normally polished at a portion of the wafer contacting the inside of the move pad piece 422 having the constant width.

According to exemplary embodiments of the present invention as described above, a chemical mechanical polishing apparatus comprises a plurality of pad pieces, wherein each pad pieces can be moved from the center of a wafer to the outer edge of the wafer, and the sojourning time and position of the pad pieces can be controlled, thereby uniformly planarizing a semiconductor wafer. Thus, it is possible to obtain a uniform planarized surface of a semiconductor wafer having a deposition of varying thickness on the surface wafer

What is claimed is:

1. A chemical mechanical polishing (CMP) apparatus, comprising:

a plate that holds a substrate; a polishing pad including pad pieces, wherein the polishing pad has a circular shape, a triangular shape, a quadrangular shape, or an elliptical shape;

a pad assembly unit comprising a pad support device and a positioning device, wherein the pad support device comprises a plurality of support plates to which the pad pieces of the polishing pad can be attached, and wherein the positioning device can move at least one of the plurality of support plates in a direction along a surface of a substrate to be polished; and a rotation device operatively connected to the pad assembly unit.

2. The CMP apparatus of claim 1, wherein the positioning device moves at least one of the plurality of support plates to a position between a center region and an edge region of a substrate.

3. The CMP apparatus of claim 1, wherein the positioning device comprises:

a motor;

a screw that rotates by operation of the motor; and a rod which is connected to one of the plurality of support plates and which moves by rotation of the screw.

4. The CMP apparatus of claim 3, further comprising a controller to control a rotation speed of the motor.

5. The CMP apparatus of claim 1, wherein the pad pieces of the circular-shaped polishing pad have a same fan shape.

6. The CMP apparatus of claim 1, wherein the positioning device moves the plurality support plates by dispersing the plurality of support plates from the center of the substrate and by concentrating the plurality of support plates to the center of the substrate.

7. A chemical mechanical polishing (CMP) apparatus, comprising:

a plate that holds a substrate;

a pad assembly unit comprising a pad support device and a positioning device, wherein the pad support device comprises a plurality of support plates to which pad pieces of a polishing pad can be attached, and wherein the positioning device can move at least one of the plurality of support plates in a direction along a surface of a substrate to be polished; and a rotation device operatively connected to the pad assembly unit, wherein the plurality of support plates include a fixed support plate and a plurality of movable support plates disposed around the fixed support plate.

8. The CMP apparatus of claim 7, wherein the positioning device includes:

a motor;

a screw that rotates by operation of the motor; and a rod which is connected to one of the movable support plates and which moves by rotation of the screw.

9. The CMP apparatus of claim 8, further comprising a controller to control a rotation speed of the motor.

10. The CMP apparatus of claim 9, further comprising a polishing pad including pad pieces, wherein the polishing pad including the pad pieces has a circular shape, a triangular shape, or an elliptical shape.

11. The CMP apparatus of claim 7, wherein the fixed support plate has a circular shape, a triangular shape, or an elliptical shape and the plurality of movable support plates disposed around the fixed center support plate forms the shape of a circle, a triangle, or an ellipse.

12. The CMP apparatus of claim 7, werein the fixed support plate is disposed at the center of the substrate, and wherein the positioning device moves the plurality of movable support plates by dispersing the plurality of movable support plates from the fixed support plate and by concentrating the plurality of movable support plates to the fixed support plate.

13. A chemical mechanical polishing (CMP) apparatus, comprising:

a plate that holds a substrate;

a pad assembly unit comprising a pad support device and a positioning device, wherein the pad support device comprises a plurality of support plates to which pad pieces of a polishing pad can be attached, and wherein the positioning device comprises a housing, a plurality of motors attached to the housing, a plurality of screws rotatably attached to the housing, and wherein each screw is coupled to a corresponding motor, and a plurality of connecting rods each having a screw groove, wherein each connecting rod is coupled to a corresponding support plate and to a corresponding screw through the screw groove; and a rotation device operatively connected to the pad assembly unit.

14. The chemical mechanical polishing apparatus of claim 13, wherein each motor rotates a corresponding screw to move a corresponding support plate back and forth along an axial direction of the screw.

15. The CMP apparatus of claim 13, wherein the rotational device operatively coupled to the housing rotates the housing and the plurality of support plates about a substrate to be polished.

16. The CMP apparatus of claim 13 further comprising a controller to control a rotation speed of the motors.

17. The CMP apparatus of claim 13, wherein the plurality of support plates together forms a circular shape, a quadrangular shape, a triangular shape, or an elliptical shape.

18. The CMP apparatus of claim 13, wherein the plurality of support plates includes a fixed support plate and a plurality of movable support plates disposed around the fixed support plate.

19. The CMP apparatus of claim 18, wherein the fixed support plate is a circular shape, a triangular shape, or an elliptical shape and the movable support plates disposed around the fixed support plate form a circular shape, a triangular shape, or an elliptical shape.

20. The CMP apparatus of claim 19, further comprising a polishing pad comprising a plurality of pad pieces attached to the plurality of support plates.

21. The CMP apparatus of claim 13, further comprising a polishing pad comprising a plurality of pad pieces of a polishing pad, wherein the polishing pad has a circular shape, a triangular shape, a quadrangular shape, or an elliptical shape.

22. A pad assembly unit for a chemical mechanical polishing (CMP) apparatus, the pad assembly unit comprising:

a pad support device comprising a plurality of support plates to which pad pieces of a polishing pad can be attached; and a positioning device that can move at least one of the plurality of support plates in a direction along a surface of a substrate to be polished, wherein the plurality of support plates include a fixed support plate and a plurality of movable support plates.

23. The pad assembly unit of claim 22, wherein the positioning device includes:

a motor;

a screw that rotates by operation of the motor; and a rod which is connected to one of the plurality of support plates and which moves by rotation of the screw.

24. The pad assembly unit of claim 22, further comprising a controller to control the operation of the positioning device.

* * * * *